US008129893B2

(12) United States Patent
Li

(10) Patent No.: US 8,129,893 B2
(45) Date of Patent: Mar. 6, 2012

(54) QUICK START SHIELDED FLUORESCENT LAMP AND METHOD FOR PRODUCING THE SAME

(75) Inventor: Yang Li, Shangyu (CN)

(73) Assignee: Zhejiang Yankon Group Co., Ltd., Shangyu (CN)

( * ) Notice: Subject to any disclaimer, the term of this patent is extended or adjusted under 35 U.S.C. 154(b) by 0 days.

(21) Appl. No.: 12/912,792

(22) Filed: Oct. 27, 2010

(65) Prior Publication Data

US 2011/0101850 A1 May 5, 2011

(30) Foreign Application Priority Data

Oct. 30, 2009 (CN) ..... 2009 1 0153707
Dec. 31, 2009 (CN) ..... 2009 1 0157040

(51) Int. Cl.
*H01J 17/26* (2006.01)
*H01J 61/24* (2006.01)

(52) U.S. Cl. ..... 313/490; 313/25; 313/493; 313/565; 313/573; 313/634; 445/10; 445/26

(58) Field of Classification Search ..... None
See application file for complete search history.

(56) References Cited

U.S. PATENT DOCUMENTS 7,256,547 B2 * 8/2007 Kubota et al. ..... 315/56
2006/0273720 A1 * 12/2006 Kwong ..... 313/569

* cited by examiner

*Primary Examiner* — Ashok Patel
(74) *Attorney, Agent, or Firm* — Matthias Scholl P.C.; Matthias Scholl

(57) ABSTRACT

A quick start energy-saving fluorescent lamp comprising a bulb holder assembly, a light tube, a glass shade, a protruding cold end, a thermal insulation glue, and an amalgam vapor source. The protruding cold end is disposed at the front end of the light tube and contacts with the glass shade. The thermal insulation glue is disposed outside and around the cold end. The amalgam vapor source is disposed inside the cold end. The lamp can work at high temperature with low temperature amalgam vapor source and maintain high luminous efficiency, and the lamp can reach the rated brightness quickly. A method for producing the lamp is also provided.

17 Claims, 6 Drawing Sheets

QUICK START SHIELDED FLUORESCENT LAMP AND METHOD FOR PRODUCING THE SAME

CROSS-REFERENCE TO RELATED APPLICATIONS

Pursuant to 35 U.S.C. §119 and the Paris Convention Treaty, this application claims the benefit of Chinese Patent Application No. 200910153707.5 filed Oct. 30, 2009 and No. 200910157040.6 filed Dec. 31, 2009, the contents of which are incorporated herein by reference.

BACKGROUND OF THE INVENTION

1. Field of the Invention

The invention relates to an energy-saving fluorescent lamp, and more particularly to a quick start shielded energy-saving fluorescent lamp, as well as a method for producing the same.

2. Description of the Related Art

Energy-saving fluorescent lamps, particularly shielded energy-saving fluorescent lamps, which are very similar to incandescent lamps in appearance, have aroused more and more attention. However, these lamps have a common disadvantage at work, i.e., it takes a long time to achieve the rated brightness. The disadvantage is decided by the inherent characteristics of conventional shielded energy-saving fluorescent lamps. The shade blocks the diffusion of the lamp heat, so the lamps have higher temperature than those without a shade (naked lamps). The working principle of the energy-saving fluorescent lamps is to generate light by maintaining low pressure mercury vapor. To achieve a high luminous efficiency, the mercury vapor pressure must be maintained at a reasonable value. When lamps work at high temperature, to obtain a suitable mercury vapor pressure, high temperature amalgam must be used. Upon turning on the lamps, the initial temperature is low, so is the mercury vapor pressure generated by the high temperature amalgam, the lamps have low brightness. With the increase of the lamp temperature, the mercury vapor pressure and the brightness increase, so does the luminous flux. Generally, it takes 60-120 seconds to reach 80% of the rated luminous flux. Thus, conventional shielded fluorescent lamps cannot be lighted immediately just like an incandescent lamp. The brightness is decided by the mercury vapor pressure, and the mercury vapor pressure is decided by a cold-end temperature. Thus, the light brightness is finally decided by the cold-end temperature.

Because conventional fluorescent lamps adopt high temperature amalgam, they cannot be lighted immediately. Thus, to make the shielded fluorescent lamps lighted quickly, a sufficiently low temperature cold end can be disposed in the lamps so that the low temperature amalgam can be used.

SUMMARY OF THE INVENTION

In view of the above-described problems, it is one objective of the invention to provide a shielded energy-saving fluorescent lamp that can use low temperature amalgam and reach rated brightness quickly.

To achieve the above objectives, in accordance with one embodiment of the invention, there is provided a shielded energy-saving fluorescent lamp that can use low temperature amalgam and reach rated brightness quickly, the lamp comprising a bulb holder assembly, a light tube, a glass shade, a protruding cold end, a thermal insulation glue, and an amalgam vapor source; wherein the protruding cold end is disposed at the front end of the light tube and contacts with the glass shade; the thermal insulation glue is disposed outside and around the protruding cold end, and the amalgam vapor source is disposed inside the protruding cold end.

In a class of this embodiment, a transparent truncated cone is disposed outside and encloses the protruding cold end; the thermal insulation glue is disposed inside the transparent truncated cone, and the larger opening of the transparent truncated cone faces the glass shade.

In a class of this embodiment, the protruding cold end comprises a convex bubble and a convex bubble wall; a third electrode is disposed on the convex bubble and passes the convex bubble wall; an inner end of the third electrode extends into the light tube, and an outer end of the third electrode contacts with the glass shade; and the amalgam vapor source is adhered to the third electrode.

In a class of this embodiment, the third electrode is two dumet wires.

In a class of this embodiment, the protruding cold end comprises a convex bubble; the convex bubble contacts directly with the glass shade; the amalgam vapor source is a solid amalgam and disposed in the convex bubble; and a positioning device is disposed in the rear part of the convex bubble.

In a class of this embodiment, the positioning device is a convex glass ring.

In a class of this embodiment, the positioning device is a barrier.

Advantages of the shielded energy-saving fluorescent lamp are summarized below:

1) the protruding cold end disposed in the front end of the light tube contacts with the glass shade; the amalgam vapor source is disposed in the cold end; and the thermal insulation glue is disposed outside and around the cold end; all these ensure the light tube can utilize a low temperature amalgam vapor source (for example, spherical Bi—Sn—Hg pills with diameters of 1 mm and working temperature of less than 55° C.) even working at high temperature but not affect the luminous efficiency; thus, the shielded energy-saving fluorescent lamp can be lighted quickly;

2) the thermal insulation glue disposed outside and around the cold end separates the heat air in the cold end from that in the glass shade, prevents the cold end from heating by the heat air in the glass shade; thus, the cooling effect of the cold end is improved and the temperature of the cold end can be further reduced;

3) the transparent truncated cone is disposed outside and encloses the cold end; the thermal insulation glue is disposed inside the transparent truncated cone, and the larger opening of the transparent truncated cone faces the glass shade; all these reduce the use amount of the thermal insulation glue but not affect heat insulating effect, and reduce the production cost of lamps; and 4) the third electrode is disposed on the convex bubble and passes the convex bubble wall; the inner end of the third electrode extends into the light tube, and the outer end of the third electrode contacts with the glass shade; and the amalgam vapor source is adhered to the third electrode; thus, the third electrode functions as a cooling channel of the cold end, on the one hand, absorbing the heat of the cold end and transferring to the glass shade where the heat is diffused, on the other hand, the third electrode plays the following roles: a) to support a solid amalgam: solid amalgams may roll in conventional lamps and cause the falling of the phosphor layer; in the invention, the solid amalgam is adhered to the third electrode, so the roll of the solid amalgam is prevented; b) to further reduce the amalgam vapor pressure: the third electrode is on the edge of the plasma formed in the lamp, due to the interaction of the carriers between the electrode and the plasma, a "cover layer" forms where electrochemical effect happens, which reduces the amalgam vapor concentration and further reduces the amalgam vapor pressure; and c) reducing the load of the inner wall of the cold end: the tip of the third electrode inside the cold end can effectively reduce the negative charges adhered to the phosphor layer of the inner surface of the cold end, thereby reducing the load of the inner wall of the cold end and reducing the temperature of the cold end.

In accordance with another embodiment of the invention, there is provided another shielded energy-saving fluorescent lamp that can use low temperature amalgam and reach rated brightness quickly, the lamp comprising a lamp holder assembly, an upper shade, a lower shade, an electronic ballast, a spiral tube, a glass shade, a protruding cold end, and a thermal insulation glue; wherein the protruding cold end has a height of 4-10 mm and is disposed at the front end of the spiral tube and the top thereof contacts with the bottom of the inner wall of the glass shade; a mercury vapor source is disposed inside the protruding cold end; the thermal insulation glue is transparent and disposed at the bottom of the glass shade; and the protruding cold end is surrounded by the thermal insulation glue.

In a class of this embodiment, the temperature characteristic of the mercury vapor source matches that of the cold end.

In a class of this embodiment, the mercury vapor source is a solid amalgam or liquid mercury.

In a class of this embodiment, the spiral tube comprises two tube holders, each provided with two guide wires; the lower shade comprises a shade body and a base plate; the shade body is connected with the upper shade; the base plate is provided with two tube mounting bases at its bottom; the tube mounting base is provided with tube mounting holes penetrating through the tube mounting bases and the base plate for connection with the shade body along its axial direction; the tube mounting holes match with the tube holder; the top of the tube mounting hole is provided with a limit plate used to limit the moving distance of the spiral tube; the electronic ballast is placed on the base plate, comprising a PCB circuit board with a component side and a solder side; the solder side faces the tube holder matching with the tube mounting hole; the PCB circuit board is provided with four wrap pins; the tube holder matches with the tube mounting hole; when the space between the end surface of the tube holder and the underside of the limit plate is controlled at 3-5 mm, four guide wires are wrapped on the four wrap pins, respectively.

In a class of this embodiment, the PCB circuit board is provided with jacks matching with the wrap pins; the wrap pins are provided with a first and a second limit parts with four edge angles; the lower part of the first limit part is in tight contact with the jack; a part of the wrap pin located between the first and the second limit parts serves as the main part of the wrap pin; the guide wire is wrapped on the main part of the wrap pin; and the second limit part is used to limit the sliding distance of the guide wires.

In a class of this embodiment, a circular groove matching with the opening of glass shade is formed between the inner wall of the upper shade and the outer wall of the shade body when the upper shade is covered on and fixed to the shade body; high viscosity inert organic silicon glue with poor fluidity is provided inside the circular groove.

In a class of this embodiment, the PCB circuit board is provided with a notch used to receive the guide wire.

In another respect, the invention provides a method for producing the shielded energy-saving lamp comprising the steps of:

a) inserting two tube holders of the spiral tube into the tube mounting holes provided on the two tube mounting bases, respectively;

b) placing the PCB circuit board of the electronic ballast on the base plate of the lower shade, the solder side of the PCB circuit board facing the tube holder;

c) keeping the space between the end surface of the tube holder and the limit plate on the top of tube mounting hole at 3-5 mm, penetrating the guide wire of the tube holder through the notch on the PCB circuit board, and wrapping on the main part of the wrap pin;

d) fixing the upper shade to the shade body of the lower shade to form a circular groove matching with the opening of the glass shade between the inner wall of the upper shade and the outer wall of the shade body, arranging the power line as per conventional process, and installing the lamp holder assembly on the top of the upper shade;

e) injecting the high viscosity inert organic silicon glue with bad fluidity into the circular groove;

f) injecting transparent thermal insulation glue into the glass shade, the opening of the glass shade being upwards;

g) keeping an integrated structure formed through connection of the lamp holder assembly, the upper shade, the lower shade, and the spiral tube upright, the lamp holder assembly and the spiral tube being on the top and at the bottom, respectively; installing the spiral tube into the glass shade before solidification of the thermal insulation glue so that the top of cold end is in contact with the bottom of the inner wall of the glass shade, the cold end being located inside the thermal insulation glue;

h) pushing the spiral tube until the edge of the opening of the glass shade is thoroughly set into the organic silicon glue, the tube holder moving upward along the tube mounting hole when pushing the spiral tube;

i) shaping and positioning the energy-saving lamp with a fixture, placing the energy-saving lamp in the room with ambient temperature no less than 25° C. for more than 3 hours; and j) unloading the fixture and placing the energy-saving lamp into a transfer box for more than 8 hours.

As compared with the prior art, the invention is characterized in that a protruding part with a definite height is provided at the front end of the spiral tube to serve as the cold end. The protruding part has the lowest temperature on the whole spiral tube. The cold end contacts with the bottom of the glass shade, and is surrounded by the thermal insulation glue. The mercury vapor source is disposed in the cold end so that the tube working in the environment of high temperature is available for use of low-temperature mercury vapor source. This is conducive to the maintenance of luminance of the energy-saving lamp as well as realization of quick start. The thermal insulation glue blocks the hot air from the inside of the glass shade and thus properly controls the temperature of the cold end. It is applicable to ensure ideal luminance and quicker increment in luminous flux of the spiral tube through selection of mercury vapor source whose temperature characteristic is in compatible with that of the cold end.

Conventional assembly methods of a shielded energy-saving lamp affect the yield and quality. However, the assembly method of the invention has good effects. As indicated by experiments and experimental results, the contact between the cold end on the top of each spiral tube and the bottom of the inner wall of the glass shade is almost perfect and is not affected by the dimensional tolerance of the spiral tube and the glass shade. Furthermore, the method is also available for one-off abutting joint installation, before solidification of the thermal insulation glue, between the spiral tube and the glass shade as well as between the opening of the glass shade and the groove formed between the upper and the lower shade. Thus, it can significantly improve the yield and quality of the energy-saving lamp.

BRIEF DESCRIPTION OF THE DRAWINGS

The invention is described hereinbelow with reference to accompanying drawings, in which.

DETAILED DESCRIPTION OF THE EMBODIMENTS

For further illustrating the invention, experiments detailing a shielded energy-saving fluorescent lamp are described below. It should be noted that the following examples are intended to describe and not to limit the invention.

Embodiment 1

Figure 1:
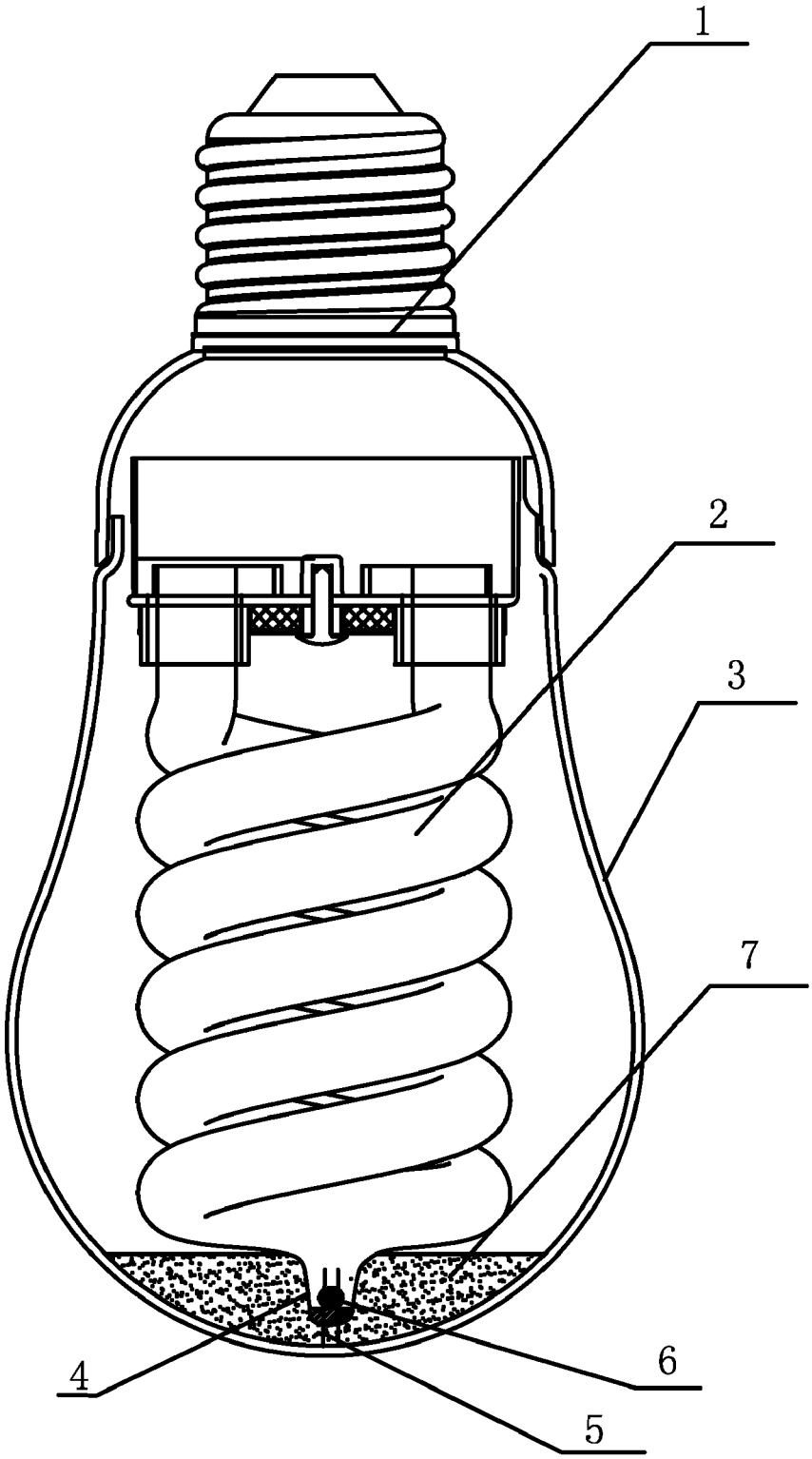
FIG. 1 is a schematic diagram of a shielded energy-saving fluorescent lamp according to one embodiment of the invention.
Figure 3:
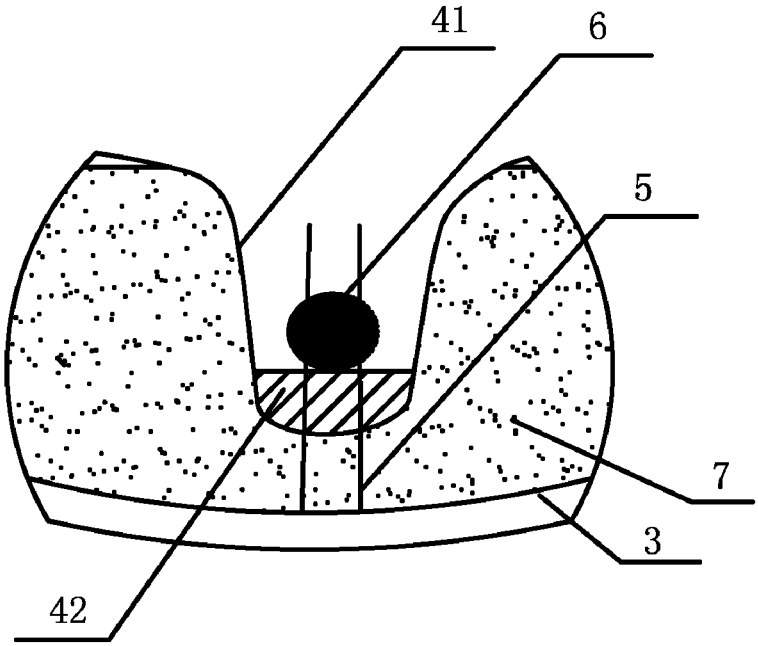
FIG. 3 is a partial enlarged view of FIG. 1.

As shown in FIGS. 1 and 3, a quick start shielded energy-saving fluorescent lamp comprises a bulb holder assembly 1, a light tube 2, and a glass shade 3. A protruding cold end 4 is disposed at the front end of the light tube 2. The protruding cold end 4 comprises a convex bubble 41 and a convex bubble wall 42. A third electrode 5 is disposed on the convex bubble 41 and passes the convex bubble wall 42. The third electrode 5 is two dumet wires. An inner end of the third electrode 5 extends into the light tube 2, and an outer end of the third electrode 5 contacts with the glass shade 3 by pasting. A solid amalgam 6 is adhered to the third electrode 5. A thermal insulation glue 7 is disposed outside and around the protruding cold end 4.

Embodiment 2

Figure 2:
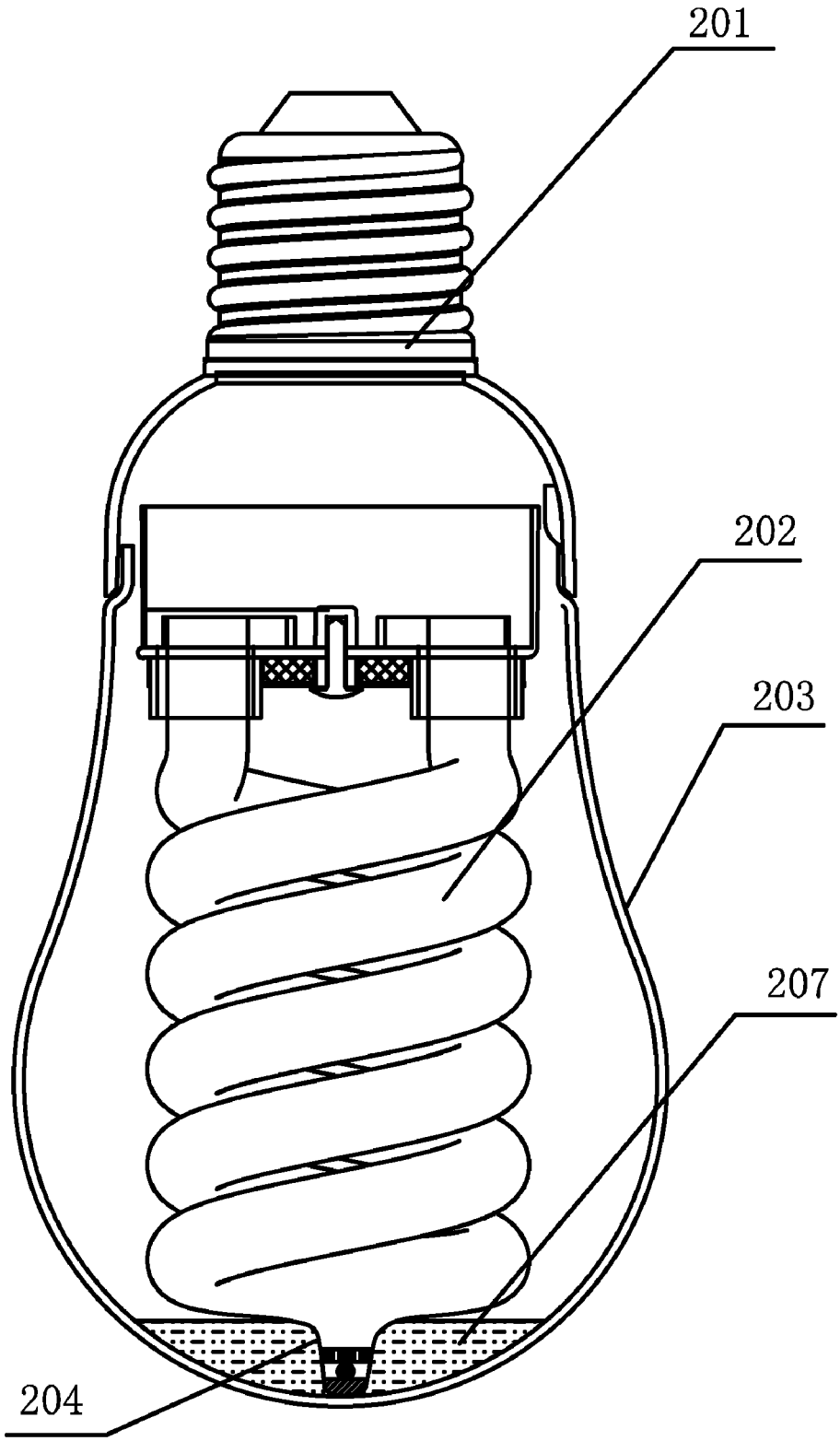
FIG. 2 is a schematic diagram of another shielded energy-saving fluorescent lamp according to one embodiment of the invention.
Figure 4:
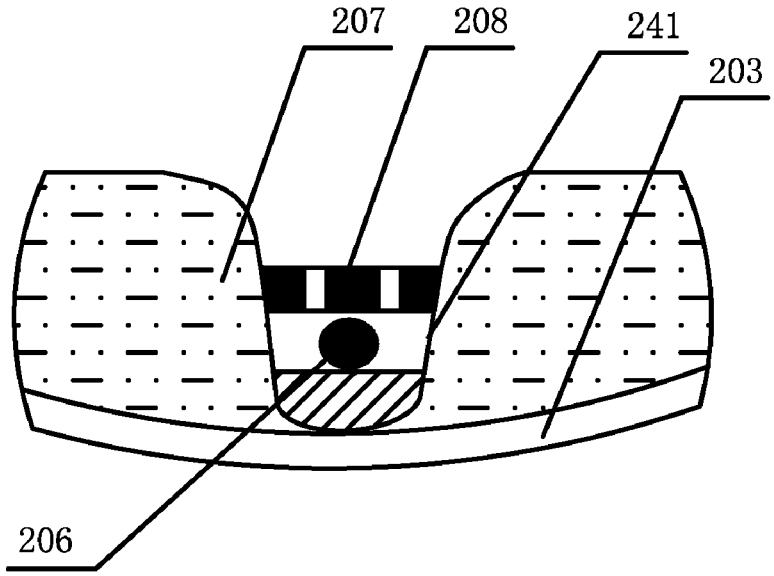
FIG. 4 is a partial enlarged view of FIG. 2.

As shown in FIGS. 2 and 4, a quick start shielded energy-saving fluorescent lamp comprises a bulb holder assembly 201, a light tube 202, and a glass shade 203. A protruding cold end 204 is disposed at the front end of the light tube 202. The protruding cold end 204 comprises a convex bubble 241. The convex bubble 241 contacts directly with the glass shade 203. A solid amalgam 206 is disposed inside the convex bubble 241. A barrier 208 is disposed in the rear part of the convex bubble 241 to limit the roll of the solid amalgam 206. A thermal insulation glue 207 is disposed outside and around the protruding cold end 204.

Embodiment 3

Figure 5:
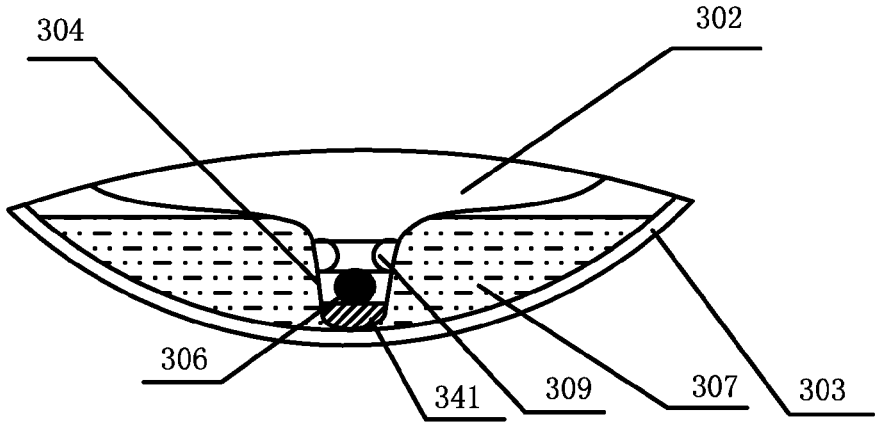
FIG. 5 is a partial view of still another shielded energy-saving fluorescent lamp according to one embodiment of the invention.

As shown in FIG. 5, a quick start shielded energy-saving fluorescent lamp comprises a bulb holder assembly (not shown), a light tube 302, and a glass shade 303. A protruding cold end 304 is disposed at the front end of the light tube 302. The protruding cold end 304 comprises a convex bubble 341. The convex bubble 341 contacts directly with the glass shade 303. A solid amalgam 306 is disposed inside the convex bubble 341. A convex glass ring 309 is disposed in the rear part of the convex bubble 341 to limit the roll of the solid amalgam 306. A thermal insulation glue 307 is disposed outside and around the protruding cold end 304.

Embodiment 4

Figure 6:
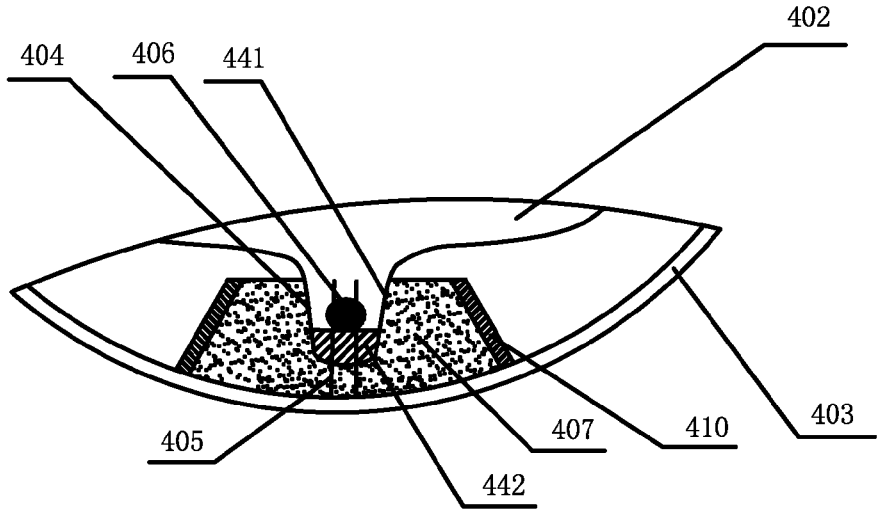
FIG. 6 is a partial view of still another shielded energy-saving fluorescent lamp according to one embodiment of the invention.

As shown in FIG. 6, a quick start shielded energy-saving fluorescent lamp has the same structure as that in embodiments 1 and 3 except that a transparent truncated cone 410 is disposed outside and encloses the protruding cold end 404. The thermal insulation glue 407 is disposed inside the transparent truncated cone 410, and the larger opening of the transparent truncated cone 410 faces the glass shade 403. The other reference numbers 402, 405, 406, 441, and 442 represent the corresponding elements as disclosed in embodiment 1 and 3.

Embodiment 5

Figure 7:
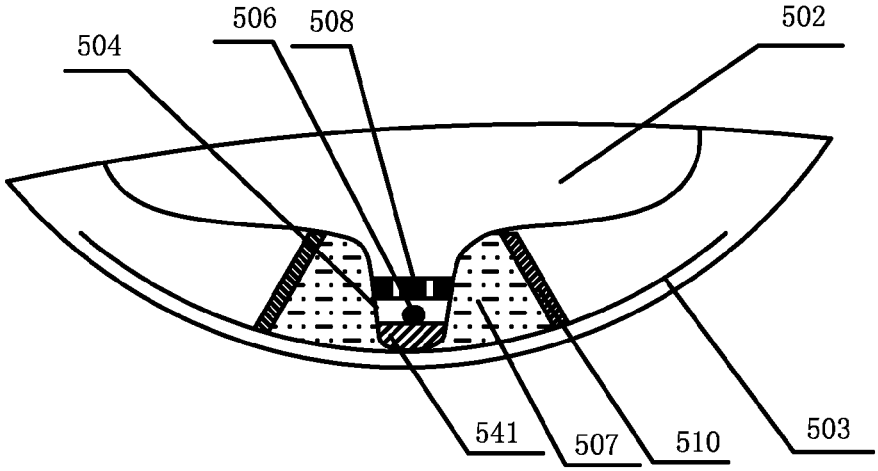
FIG. 7 is a partial view of still another shielded energy-saving fluorescent lamp according to one embodiment of the invention.

As shown in FIG. 7, a quick start shielded energy-saving fluorescent lamp has the same structure as that in embodiment 2 except that a transparent truncated cone 510 is disposed outside and encloses the protruding cold end 504. The other reference numbers 502, 503, 506, 507, 508, and 541 represent the corresponding elements as disclosed in embodiment 2.

Embodiment 6

Figure 8:
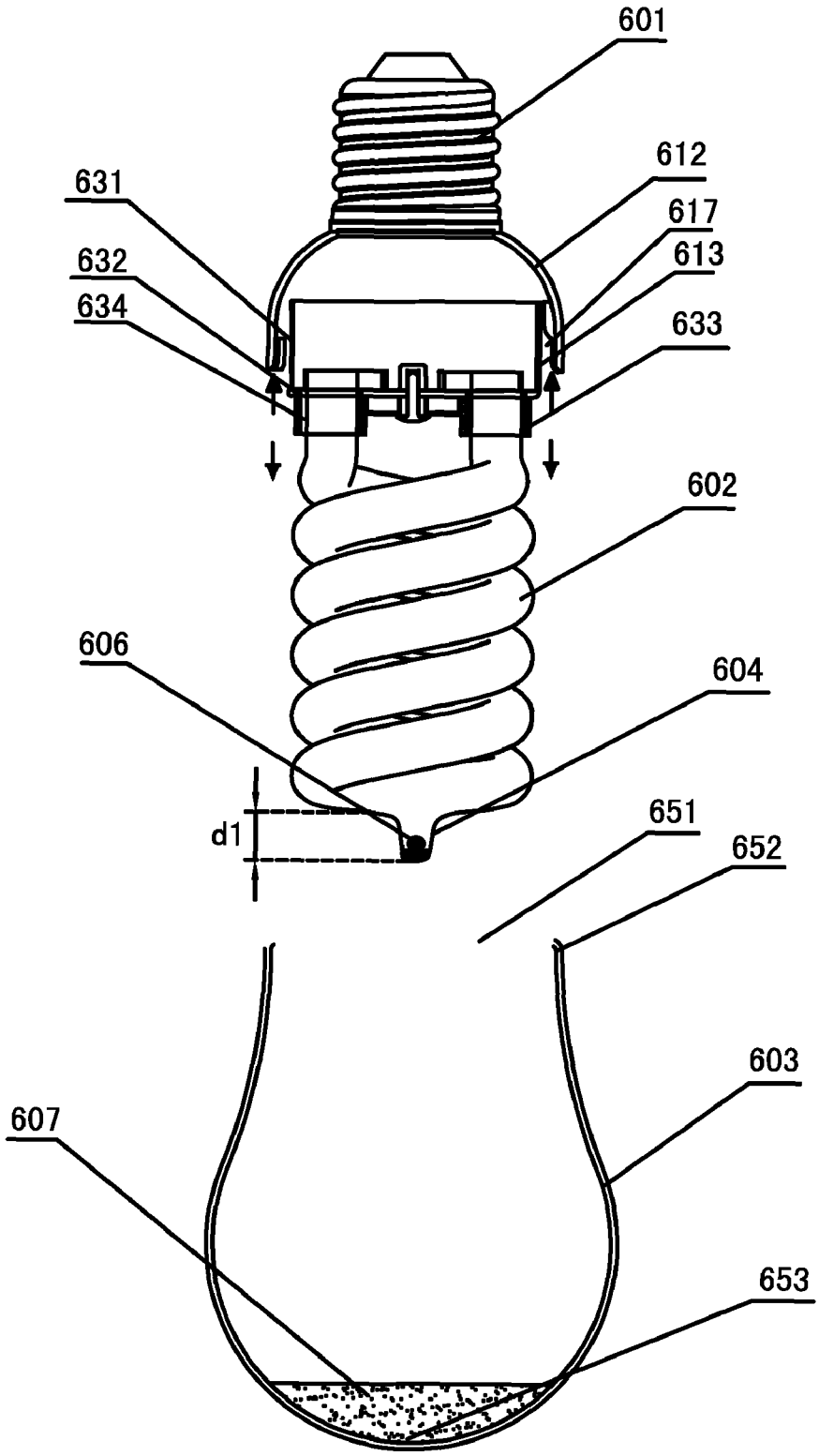
FIG. 8 is an assembly schematic diagram of a shielded energy-saving lamp according to one embodiment of the invention.
Figure 9:
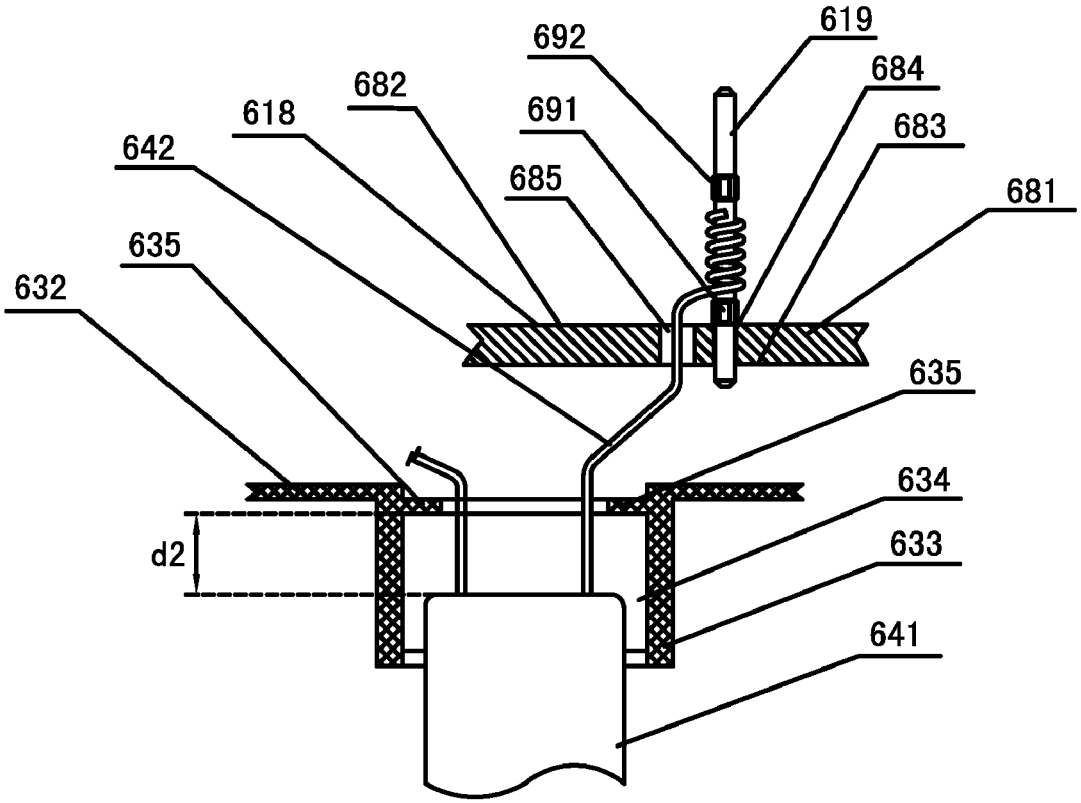
FIG. 9 is a partial view for illustrating the match between a tube holder and a tube mounting hole and between a guide wire and a wrap pin according to one embodiment of the invention.
Figure 10:
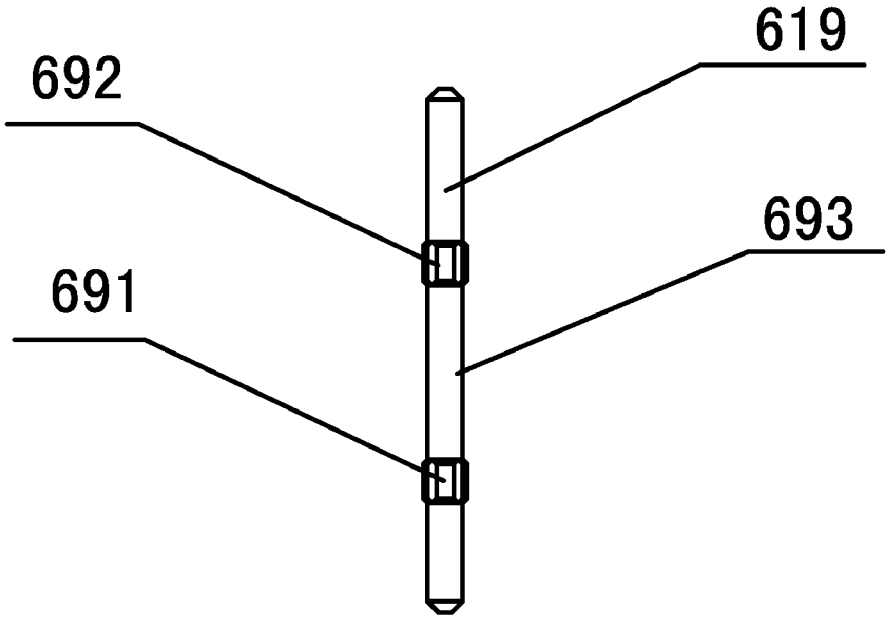
FIG. 10 is a schematic diagram of a wrap pin of a shielded energy-saving lamp according to one embodiment of the invention.

As shown in FIGS. 8, 9, and 10, a quick start shielded energy-saving fluorescent lamp comprises a lamp holder assembly 601, an upper shade 612, a lower shade 613, an electronic ballast 618, a spiral tube 602, a glass shade 603, a protruding cold end 604, and a thermal insulation glue 607. The protruding cold end 604 has a height of 4-10 mm and is disposed at the front end of the spiral tube 602 and the top thereof contacts with the bottom of the inner wall of the glass shade 603. A mercury vapor source 606 is disposed inside the protruding cold end 604. The thermal insulation glue 607 is transparent and disposed at the bottom of the glass shade 603. The protruding cold end 604 is surrounded by the thermal insulation glue 607. The protruding cold end 604 is produced separately with a height d1 as needed. The protruding cold end 604 transmits the heat outside via the inner wall of the glass shade 603 and the thermal insulation glue 607 blocks the hot air from the glass shade 603. Thus, the protruding cold end 604 has the lowest temperature in the spiral tube 602. The transparent thermal insulation glue 607 is mainly used to isolate the heat produced by the spiral tube 602 from the cold end 604.

To achieve good heat transmission effect, the cold end 604 is in direct contact with the inner wall bottom 653 of the glass shade 603. Meanwhile, the transparent thermal insulation glue 607 isolates the heat produced by the spiral tube 602. Thus, the temperature of the cold end 604 is effectively controlled.

To ensure ideal luminance and quick increment in luminous flux for the spiral tube 602, the mercury vapor source 606 whose temperature characteristic matches with that of the cold end 604 is selected. The mercury vapor source 606 is a solid mercury alloy (amalgam) or liquid mercury.

The spiral tube 602 comprises two tube holders 641, each provided with two guide wires 642. The lower shade 613 comprises a shade body 631 and a base plate 632. The shade body 631 is connected with the upper shade 612. Two tube mounting bases 633 are provided at the bottom of the base plate 632. A tube mounting hole 634 penetrating through the tube mounting base 633 and the base plate 632 for connection with the shade body 631 is provided on the tube mounting base 633 in axial direction. The tube mounting hole 634 matches with the tube holder 641. It is no need to use glue to fix the tube holder 641 inserted into the tube mounting hole 634. Thus, the tube holder 641 is available for vertical movement inside the tube mounting hole 634, which facilitates free adjustment of expansion length of the spiral tube 602 when the glass shade 603 is enclosed.

A limit plate 635 is provided on the top of the tube mounting hole 634 to control the moving distance of the spiral tube 602. The electronic ballast 618 placed on the base plate 632 comprises a PCB circuit board 681 with a component side 682 and a solder side 683. The solder side 683 faces the tube holder 641 matching with the tube mounting hole 634. Four wrap pins 619 are provided on the PCB circuit board 681. When the space d2 between the end surface of the tube holder 641 and the underside of the limit plate 635 is at 3-5 mm, the tube holder 641 matches with the tube mounting hole 634 and four guide wires 642 are wrapped on the four wrap pins 619 respectively. Thus, the dimensional error upon producing the spiral tube 602 or the glass shade 603 can be offset by the motion range of 3-5 mm, and thereby forming a prefect contact between the cold end 604 and the inner wall bottom 653 of the glass shade 603.

The PCB circuit board 681 is provided with a jack 684 matching with the wrap pin 619. The wrap pin 619 is provided with a first limit part 691 and a second limit part 692 with four edge angles. The lower section of the first limit part 691 is in tight contact with the jack 684. The part of wrap pin 619 located between the first limit part 691 and the second limit part 692 serves as the main part 693 of the wrap pin. The guide wire 642 is wrapped on the main part 693 of the wrap pin. The second limit part 692 is used to limit the sliding distance of the guide wire 642. The PCB circuit board 681 is provided with a notch 685 for receiving the guide wire 642. The first limit part 691 and the second limit part 692 are fabricated through direct pressing on the wrap pin 619. For conventional electronic ballasts, only one end of the wrap pins of the PCB circuit board is provided with a limit part used to fix the wrap pin into the jack. In the invention, two limit parts are provided, of which, the second limit part 692 plays a role of tightening the guide wire 642 on the spiral tube 602. The guide wire 642 is unlikely to slip off after it is wrapped on the main part 693 of the wrap pin due to the obstruction of the second limit part 692, which effectively prevents the guide wire 642 wrapped on the wrap pin 619 from sliding and becoming loose due to the advancement of the tube holder 641 to the tube mounting hole 634 in case of assembly of the energy-saving lamp.

A circular groove 617 matching with an edge 652 of the glass shade 603 is formed between the inner wall of the upper shade 612 and the outer wall of the shade body 631 when the upper shade 612 is covered on and fixed to the shade body 631. The circular groove 617 is provided with a high viscosity inert organic silicon glue with poor fluidity (not indicated in the figures).

Embodiment 7

Conventional assembly methods of a shielded energy-saving lamp cannot ensure an effective contact between the cold end on the top of each spiral tube and the bottom of the inner wall of the glass shade and not affected by the dimensional tolerance of the spiral tube and the glass shade. Furthermore, with conventional methods, one-off abutting joint installation, before solidification of the thermal insulation glue, between the spiral tube and the glass shade as well as between the opening of the glass shade and the groove formed between the upper and the lower shade, cannot be achieved. The invention provides a method effectively solving the above problems.

A method for producing the shielded energy-saving lamp comprises the steps of:

a) inserting two tube holders 641 of the spiral tube 602 into the tube mounting holes 634 provided on the two tube mounting bases 633, respectively;

b) placing the PCB circuit board 681 of the electronic ballast 618 on the base plate 632 of the lower shade 613, the solder side 683 of the PCB circuit board 681 facing the tube holder 641;

c) keeping the space between the end surface of the tube holder 641 and the limit plate 635 on the top of tube mounting hole 634 at 3-5 mm, penetrating the guide wire 642 of the tube holder 641 through the notch 685 on the PCB circuit board 681, and wrapping on the main part 693 of the wrap pin 619;

d) fixing the upper shade 612 on the shade body 631 of the lower shade 613 to form a circular groove 617 matching with the opening 651 of the glass shade 603 between the inner wall of the upper shade 612 and the outer wall of the shade body 631, arranging the power line as per conventional process, and installing the lamp holder assembly on the top of the upper shade 612;

e) injecting the high viscosity inert organic silicon glue with bad fluidity into the circular groove 617;

f) injecting transparent thermal insulation glue 607 into the glass shade 603, the opening 651 of the glass shade 603 being upwards;

g) keeping an integrated structure formed through connection of the lamp holder assembly 601, the upper shade 612, the lower shade 613, and the spiral tube 602 upright, the lamp holder assembly 601 and the spiral tube 602 being on the top and at the bottom, respectively; installing the spiral tube 602 into the glass shade 603 before solidification of the thermal insulation glue 607 so that the top of cold end 604 is in contact with the bottom 653 of the inner wall of the glass shade 603, the cold end 604 being located inside the thermal insulation glue 607;

h) pushing the spiral tube 602 until the opening 651 of the glass shade 603 is thoroughly set into the organic silicon glue, the tube holder 641 moving upward along the tube mounting hole 634 when pushing the spiral tube 602;

i) shaping and positioning the energy-saving lamp with a fixture, placing the energy-saving lamp in the room with ambient temperature no less than 25° C. for more than 3 hours; and j) unloading the fixture and placing the energy-saving lamp into a transfer box for more than 8 hours.

In the embodiments, the light tube 2, 202, 302, 402, and 502 is spiral or in other acceptable shape. The glass cover 3, 203, 303, 403, and 503 is bubble-shaped, spherical, barrel-shaped, or candle-shaped. The transparent truncated cone 410 and 510 may be a transparent plastic cone.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A quick start energy-saving fluorescent lamp, comprising a) a bulb holder assembly;

b) a light tube;

c) a glass shade;

d) a protruding cold end;

e) a thermal insulation glue; and f) an amalgam vapor source;

wherein said protruding cold end is disposed at the front end of said light tube and contacts with said glass shade;

said thermal insulation glue is disposed outside and around said protruding cold end; and said amalgam vapor source is disposed inside said protruding cold end.

2. The quick start energy-saving fluorescent lamp of claim 1, wherein a transparent truncated cone is disposed outside and encloses said protruding cold end; said thermal insulation glue is disposed inside said transparent truncated cone, and the larger opening of said transparent truncated cone faces said glass shade.

3. The quick start energy-saving fluorescent lamp of claim 2, wherein said protruding cold end comprises a convex bubble and a convex bubble wall; a third electrode is disposed on said convex bubble and passes said convex bubble wall; an inner end of said third electrode extends into said light tube, and an outer end of said third electrode contacts with said glass shade; and said amalgam vapor source is adhered to said third electrode.

4. The quick start energy-saving fluorescent lamp of claim 3, wherein said third electrode is two dumet wires.

5. The quick start energy-saving fluorescent lamp of claim 1, wherein said protruding cold end comprises a convex bubble and a convex bubble wall; a third electrode is disposed on said convex bubble and passes said convex bubble wall; an inner end of said third electrode extends into said light tube, and an outer end of said third electrode contacts with said glass shade; and said amalgam vapor source is adhered to said third electrode.

6. The quick start energy-saving fluorescent lamp of claim 1, wherein said protruding cold end comprises a convex bubble; said convex bubble contacts directly with said glass shade; said amalgam vapor source is a solid amalgam and disposed in said convex bubble; and a positioning device is disposed in the rear part of said convex bubble.

7. The quick start energy-saving fluorescent lamp of claim 6, wherein said positioning device is a convex glass ring.

8. The quick start energy-saving fluorescent lamp of claim 6, wherein said positioning device is a barrier.

9. The quick start energy-saving fluorescent lamp of claim 2, wherein said protruding cold end comprises a convex bubble; said convex bubble contacts directly with said glass shade; said amalgam vapor source is a solid amalgam and disposed in said convex bubble; and a positioning device is disposed in the rear part of said convex bubble.

10. The quick start energy-saving fluorescent lamp of claim 9, wherein said positioning device is a convex glass ring.

11. The quick start energy-saving fluorescent lamp of claim 9, wherein said positioning device is a barrier.

12. A shielded energy-saving fluorescent lamp comprising a lamp holder assembly, an upper shade, a lower shade, an electronic ballast, a spiral tube, a glass shade, a protruding cold end, and a thermal insulation glue; wherein said protruding cold end has a height of 4-10 mm and is disposed at the front end of said spiral tube and the top thereof contacts with the bottom of the inner wall of said glass shade; a mercury vapor source is disposed inside said protruding cold end; said thermal insulation glue is transparent and disposed at the bottom of said glass shade; and said protruding cold end is surrounded by said thermal insulation glue.

13. The shielded energy-saving fluorescent lamp of claim 12, wherein said spiral tube comprises two tube holders, each provided with two guide wires; said lower shade comprises a shade body and a base plate; said shade body is connected with said upper shade; said base plate is provided with two tube mounting bases at its bottom; said tube mounting base is provided with tube mounting holes penetrating through said tube mounting bases and said base plate for connection with said shade body along its axial direction; said tube mounting holes match with said tube holder; the top of said tube mounting hole is provided with a limit plate used to limit the moving distance of said spiral tube; said electronic ballast is placed on said base plate, comprising a PCB circuit board with a component side and a solder side; said solder side faces said tube holder matching with said tube mounting hole; said PCB circuit board is provided with four wrap pins; said tube holder matches with said tube mounting hole; when the space between the end surface of said tube holder and the underside of said limit plate is controlled at 3-5 mm, four guide wires are wrapped on said four wrap pins, respectively.

14. The shielded energy-saving fluorescent lamp of claim 13, wherein said PCB circuit board is provided with jacks matching with said wrap pins; said wrap pins are provided with a first and a second limit parts with four edge angles; the lower part of said first limit part is in tight contact with said jack; a part of said wrap pin located between said first and said second limit parts serves as the main part of said wrap pin; said guide wire is wrapped on the main part of said wrap pin; and said second limit part is used to limit the sliding distance of said guide wires.

15. The shielded energy-saving fluorescent lamp of claim 14, wherein a circular groove matching with an opening of said glass shade is formed between an inner wall of said upper shade and an outer wall of said shade body when said upper shade is covered on and fixed to said shade body; high viscosity inert organic silicon glue with poor fluidity is provided inside said circular groove.

16. The shielded energy-saving fluorescent lamp of claim 15, wherein said PCB circuit board is provided with a notch used to receive said guide wire.

17. A method for producing a shielded energy-saving fluorescent lamp of claim 16 comprising the steps of:

a) inserting two tube holders of said spiral tube into said tube mounting holes provided on said two tube mounting bases, respectively;

b) placing said PCB circuit board of said electronic ballast on said base plate of said lower shade, said solder side of said PCB circuit board facing said tube holder;

c) keeping the space between the end surface of said tube holder and said limit plate on the top of tube mounting hole at 3-5 mm, penetrating said guide wire of said tube holder through said notch on said PCB circuit board, and wrapping on the main part of said wrap pin;

d) fixing said upper shade to said shade body of said lower shade to form a circular groove matching with said opening of said glass shade between said inner wall of said upper shade and the outer wall of said shade body, arranging said power line as per conventional process, and installing said lamp holder assembly on the top of said upper shade;

e) injecting said high viscosity inert organic silicon glue with bad fluidity into said circular groove;

f) injecting transparent thermal insulation glue into said glass shade, said opening of said glass shade being upwards;

g) keeping an integrated structure formed through connection of said lamp holder assembly, said upper shade, said lower shade, and said spiral tube upright, said lamp holder assembly and said spiral tube being on the top and at the bottom, respectively; installing said spiral tube into said glass shade before solidification of said thermal insulation glue so that the top of cold end is in contact with the bottom of the inner wall of said glass shade, said cold end being located inside said thermal insulation glue;

h) pushing said spiral tube until the edge of said opening of said glass shade is thoroughly set into said organic silicon glue, said tube holder moving upward along said tube mounting hole when pushing said spiral tube;

i) shaping and positioning said energy-saving lamp with a fixture, placing said energy-saving lamp in a room with ambient temperature no less than 25° C. for more than 3 hours; and j) unloading said fixture and placing said energy-saving lamp into a transfer box for more than 8 hours.

* * * * *